US010760378B2

(12) United States Patent
Deiters et al.

(10) Patent No.: US 10,760,378 B2
(45) Date of Patent: Sep. 1, 2020

(54) PULSER CLEANING FOR HIGH SPEED PULSER USING HIGH TORSIONAL RESONANT FREQUENCY

(71) Applicant: Baker Hughes, a GE company, LLC, Houston, TX (US)

(72) Inventors: Arne Deiters, Hannover (DE); Udo Kunisch, Houston, TX (US)

(73) Assignee: Baker Hughes Holdings LLC, Houston, TX (US)

( * ) Notice: Subject to any disclaimer, the term of this patent is extended or adjusted under 35 U.S.C. 154(b) by 166 days.

(21) Appl. No.: 16/008,523

(22) Filed: Jun. 14, 2018

(65) Prior Publication Data

US 2019/0383119 A1 Dec. 19, 2019

(51) Int. Cl.
*E21B 37/00* (2006.01)
*E21B 47/18* (2012.01)

(52) U.S. Cl.
CPC ..... *E21B 37/00* (2013.01); *E21B 47/18* (2013.01)

(58) Field of Classification Search
CPC ..... E21B 37/00; E21B 47/18; E21B 47/182
See application file for complete search history.

(56) References Cited

U.S. PATENT DOCUMENTS 3,958,217 A 5/1976 Spinnler
6,469,637 B1 10/2002 Seyler et al.
6,626,253 B2 9/2003 Hahn et al.
6,714,138 B1 * 3/2004 Turner ..... E21B 47/18 340/854.3
8,693,284 B2 4/2014 Allan et al.
10,301,879 B2 * 5/2019 Hay ..... E21B 47/18
2015/0292322 A1 * 10/2015 Logan ..... E21B 47/18 166/330
2016/0003035 A1 * 1/2016 Logan ..... E21B 47/18 340/854.6
2016/0010449 A1 * 1/2016 Liu ..... E21B 47/187 166/250.01
2016/0208953 A1 * 7/2016 Pare ..... E21B 47/12
2017/0130578 A1 * 5/2017 Skerry ..... E21B 31/03
2017/0138186 A1 * 5/2017 Lee ..... E21B 47/182
2018/0045035 A1 * 2/2018 Logan ..... E21B 47/18
2018/0230800 A1 * 8/2018 Turner ..... E21B 47/182
2019/0383119 A1 * 12/2019 Deiters ..... E21B 47/182
2020/0003466 A1 * 1/2020 Xu ..... F16K 3/02
2020/0018157 A1 * 1/2020 Sauthoff ..... E21B 34/06

* cited by examiner

*Primary Examiner* — Daniel P Stephenson
(74) *Attorney, Agent, or Firm* — Mossman Kumar & Tyler PC

(57) ABSTRACT

An apparatus for generating pressure pulses in a fluid flowing in a downhole tool includes a stator, a rotor, a motor, and an electronics module. The stator and the rotor each have one or more flow passages. The motor oscillates the rotor relative to the stator to align and misalign the flow passage(s) of the stator and the rotor to thereby generate the pressure pulses. The electronics module drives the motor using at least a first signal and a second signal. The motor causes the rotor to have an information-transmitting oscillation in response to the first signal and a cleaning oscillation in response to the second signal.

15 Claims, 4 Drawing Sheets

PULSER CLEANING FOR HIGH SPEED PULSER USING HIGH TORSIONAL RESONANT FREQUENCY

BACKGROUND OF THE DISCLOSURE

1. Field of the Disclosure

The disclosure relates generally to systems and methods for cleaning stator-rotor assemblies.

2. Description of the Related Art

Drilling fluid telemetry systems, generally referred to as mud pulse systems, are particularly adapted for telemetry of information from the bottom of a borehole to the surface of the earth during oil well drilling operations. The information telemetered may include, but is not limited to, parameters of pressure, temperature, direction and deviation of the well bore. Other parameters include logging data such as resistivity of the various layers, sonic density, porosity, induction, and pressure gradients. Valves that use a controlled restriction placed in the circulating mud stream are commonly referred to as positive pulse systems, for example see U.S. Pat. No. 3,958,217.

One type of positive pulser are oscillating shear valves as described in U.S. Pat. No. 6,626,253, the contents of which are incorporated by reference for all purposes. One illustrative system is an oscillating shear valve that comprises a non-rotating stator and a rotationally oscillating rotor. The stator and rotor may have a plurality of length wise flow passages for channeling the flow. The rotor may be connected to a drive shaft disposed within a pulser housing and driven by an electrical motor. The motor may be powered and controlled by an electronics module. The rotor may be powered in a rotationally oscillating motion such that the rotor flow passages are alternately aligned with the stator flow passages and then made to partially block the flow from the stator flow passages thereby generating pressure pulses in the flowing drilling fluid.

The flow passages may in certain situation become clogged with debris or other materials entrained in the circulating mud. This disclosure provides, in part, pulsers that are not susceptible to clogging from such entrained material.

SUMMARY OF THE DISCLOSURE

In aspects, the present disclosure provides an apparatus for generating pressure pulses in a fluid flowing in a downhole tool. The apparatus may include a stator, a rotor, a motor, and an electronics module. The stator and the rotor each have one or more flow passages. The motor oscillates the rotor relative to the stator to align and misalign the flow passage(s) of the stator and the rotor to thereby generate the pressure pulses. The electronics module drives the motor using at least a first signal and a second signal. The motor causes the rotor to have an information-transmitting oscillation in response to the first signal and a cleaning oscillation in response to the second signal.

It should be understood that examples of certain features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION

The present disclosure relates to devices and methods for enabling communication via pressure variations in a flowing fluid. Illustrative embodiments of systems and related methods for generating pressure pulses in a fluid circulated in a wellbore are discussed below. Advantageously, the disclosed pulse generating devices are less susceptible to clogging and impaired operation if the fluid includes or is replaced with a fluid that includes entrained solids. While the present disclosure is discussed in the context of a hydrocarbon producing well, it should be understood that the present disclosure may be used in any borehole environment (e.g., a geothermal well).

Figure 1:
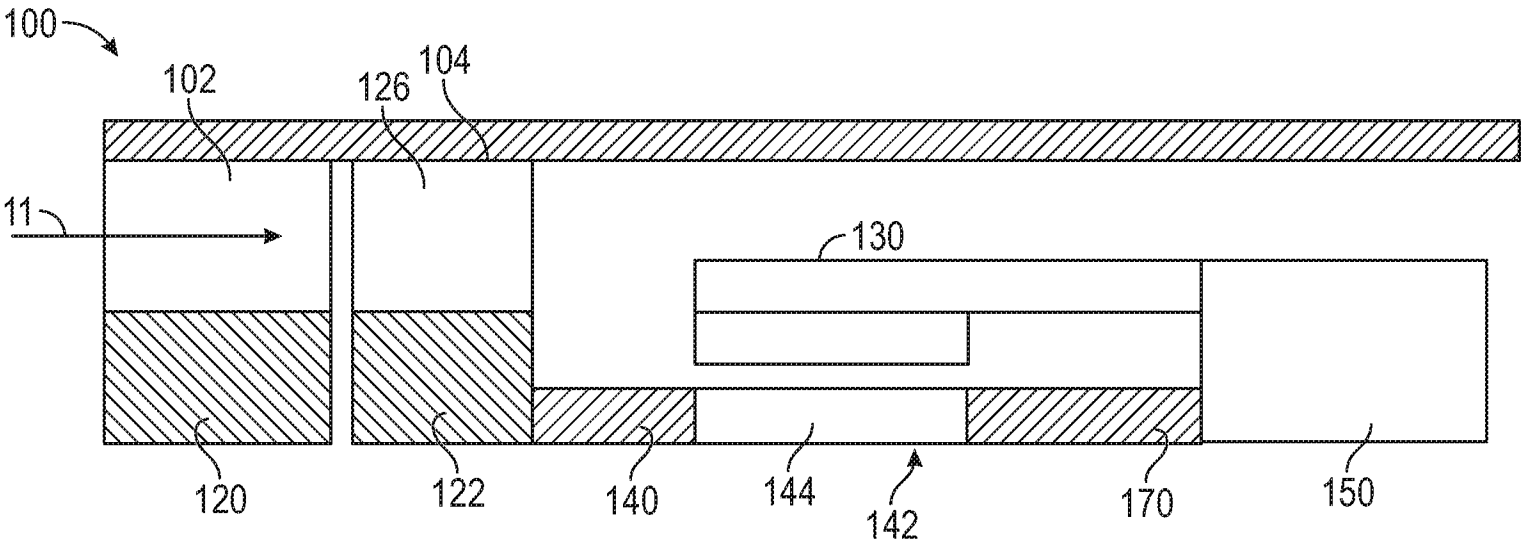
FIG. 1 is an isometric view of a pulser in accordance with one embodiment of the present disclosure.

Referring to FIG. 1, there is schematically illustrated a pulser assembly 100, also called an oscillating shear valve, that may utilize the teachings of the present disclosure. The pulser assembly 100 may be positioned in an inner bore 102 of a tool housing 104. The housing 104 may be a section of a bottom hole assembly 14 (FIG. 6) or a separate housing adapted to fit into a drill collar bore (not shown). A drilling fluid 11 flows through a stator 120 and a rotor 122 and passes through an annulus 126 between a pulser housing 130 and an inner diameter of the tool housing 104.

Figure 2B:
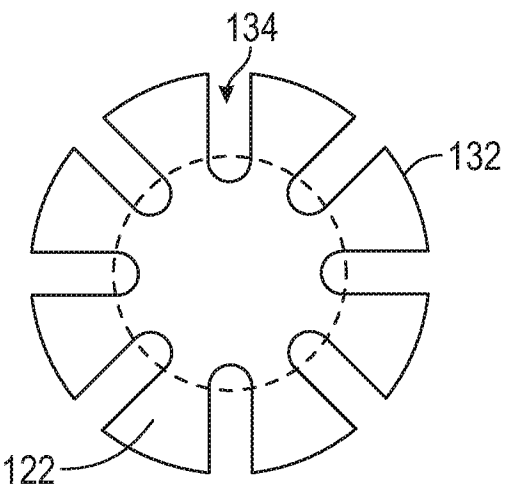
FIG. 2A, B illustrate embodiments of a stator and rotor, respectively, in accordance with embodiments of the present dislcosure.
Figure 2A:
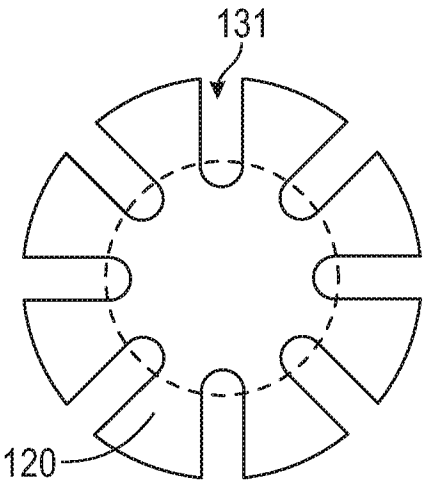

Referring to FIGS. 1 and 2A, B, the stator 120 may be fixed with respect to the tool housing 104 and to the pulser housing 130. In one arrangement, the stator 120 has a plurality of radially elongated flow passages 131. The rotor 122 may be disk shaped and have circumferentially distributed blades 132 separated by flow passages 134. The flow passages 134 may be similar in size and shape to the flow passages 131 in the stator 120. Alternatively, the flow passages 131 and 134 may be holes through the stator 120 and the rotor 122, respectively. The stator passages 131 and the rotor passages 134 may be angularly aligned to create a flow path that presents the smallest relative flow resistance to the flowing fluid 11.

The rotor 122 may be configured to rotationally oscillate such that an angular displacement of the rotor 122 with respect to the stator 120 changes the effective flow area, which then creates pressure fluctuations in the circulated mud. A pressure cycle may be generated by opening and closing the flow channel by changing the angular positioning of the rotor blades 134 with respect to the stator flow passage 131. This can be done with an oscillating movement of the rotor 122. The rotor blades 132 may be rotated in a first direction until the flow area is fully or partly restricted. This creates a pressure increase. They are then rotated in the opposite direction to open the flow path again. This creates a pressure decrease. It should be understood that it is not necessary to completely block the flow to create a pressure pulse and therefore different amounts of blockage, or angular rotation, create different pulse amplitudes.

Referring to FIG. 1, the rotor 122 may be attached to a drive shaft 140. The drive shaft 140 is connected to an electrical motor 142, which may be a reversible brushless DC motor, a servomotor, or a stepper motor. The motor 142 may be electronically controlled by circuitry in the electronics module 150. The electronics module 150 may include processors, memory modules, circuitry, and programmed algorithms that allow the rotor 122 to be precisely driven in either direction. Also, precise control of the position of the rotor 122 can enable specific shaping of the generated pressure pulse. The electronics module 150 may be preprogrammed to transmit data utilizing any of a number of encoding schemes which include, but are not limited to, Amplitude Shift Keying (ASK), Frequency Shift Keying (FSK), or Phase Shift Keying (PSK) or the combination of these techniques. As used herein, the term "signal" refers to a command sent by the electronics module 150 to the motor 142 to control the rotary output of the motor 142.

In embodiments, the motor 142 may include a shaft 144. One end of the motor shaft 144 is attached to drive shaft 140 and the other end of the motor shaft 144 may be attached to a torsion spring 170. The torsion spring 170 may be directly or indirectly anchored to the pulser housing 130. The torsion spring 170 along with the drive shaft 140 and the rotor 120 comprise a mechanical spring-mass system. The torsion spring 170 may be designed such that this spring-mass system is at its natural frequency at, or near, the oscillating pulse frequency of the pulser 100 used while transmitting signals/information. The methodology for designing a resonant torsion spring-mass system based on a torsional resonant frequency is well known in the mechanical arts and is not described here. The advantage of a resonant system is that once the system is at resonance, the motor 142 only has to provide power to overcome external forces and system dampening, while the rotational inertia forces are balanced out by the resonating system.

As noted previously, the drilling fluid 11 may intentionally or unintentionally include entrained particles. One non-limiting example of intentional entrained particles are lost circulation materials (LCM). LCM may include cotton-like or fiber weave materials or natural materials such as nut plug that can seal a borehole wall. Unintentional particles include sand and other small, hard particulates. Both such materials can clog, to varying degrees, the passages, 131, 134 of the stator 120 and rotor 122, respectively.

Embodiments of the present disclosure provide techniques and methods for maintaining stator 120, the rotor 122, and associated passages 131, 134 free of such materials and/or removing such materials if they accumulate on the surfaces of the features. The action of preventing the accumulation of entrained materials and/or removing accumulated entrained materials will collectively be referred to as "cleaning." In embodiments, the cleaning of the stator 120 and rotor 122 is effectuated by a high-frequency rotational oscillation of the rotor 122. In some embodiments, the high-frequency oscillation may be at a torsional resonant frequency of the pulser assembly 130. For convenience, the torsional resonant frequency used for cleaning will be referred to as the second torsional resonant frequency whereas the torsional frequency used for signal/information transmission will be referred to as the first torsional resonant frequency.

The methodology for cleaning the stator 120 and/or the rotor 122 using high-frequency oscillations will be described with reference to FIGS. 3-5, all of which graphically illustrate the oscillatory motion of the rotor 122 (FIG. 1, 2B) during operation. In these Figures, time is along the "X" axis 160 and angular displacement is along the "Y" axis 162.

Figure 3:
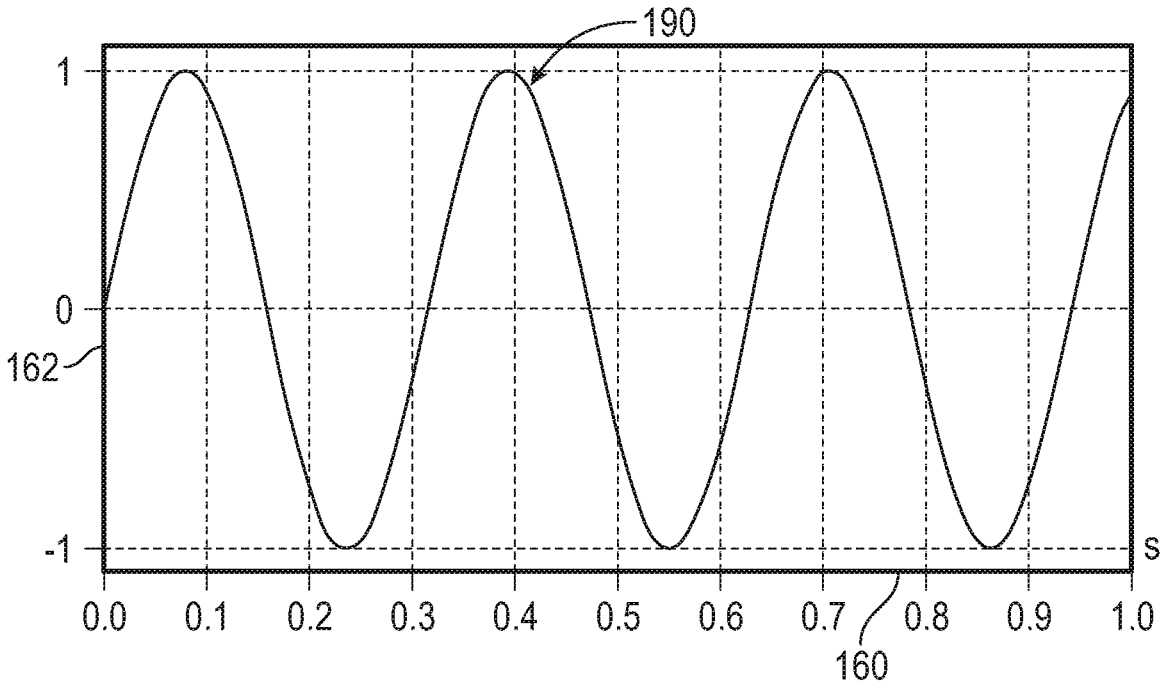
FIG. 3 illustrate an oscillation of a pulse generator during signal transmission in accordance with one embodiment of the present disclosure.

In FIG. 3, in response to control signals from the electronics module, the rotor 122 oscillates at a frequency and amplitude selected to impart pressure pulses in the drilling fluid that transmit information. For convenience, this type of oscillation will be referred to as an information-transmitting oscillation 190. During such oscillations, the rotor 122 rotates such that the flow passages 131, 134 of the stator 120 and the rotor 122, respectively, are partially or completely misaligned, which causes a flow restriction. The magnitude of the flow restriction is sufficient to generate a pressure pulse that can be detected at a remote location, e.g., at the surface. The oscillation frequency may be at a first torsional resonant frequency of the pulser assembly 130.

Figure 4:
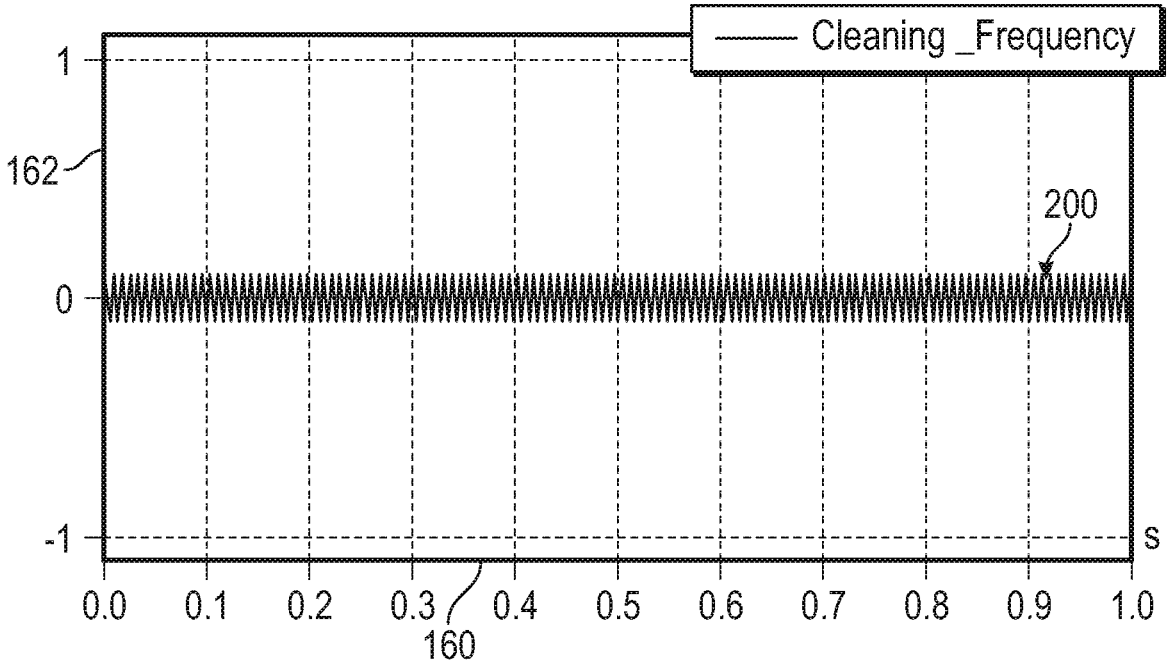
FIG. 4 illustrates an oscillation of a pulse generator during cleaning in accordance with one embodiment of the present disclosure.

In FIG. 4, in response to control signals from the electronics module 150, the rotor 122 oscillates at a frequency and amplitude selected to mechanically dislodge materials from the stator 120 and/or rotor 122. For convenience, this type of oscillation will be referred to as cleaning oscillations 200. During such oscillations, the rotor 122 rotates at a frequency that is sufficiently high to clean the stator 120 and/or rotor 122. The frequency may be a second torsional resonant frequency of the pulser assembly 130. The amplitude of the rotation is sufficiently low as to not generate a pressure pulse that can be detected at a remote location, e.g., at the surface. Additionally, the relatively smaller degree of rotation reduces power demands by the motor. As compared to the FIG. 3 pulser movement, the FIG. 4 pulser movement has a significantly higher frequency and a significantly lower amplitude. In embodiments, the frequency of the cleaning oscillation may be greater than 500 HZ, greater than 1000 HZ, or greater than 1200 HZ. In some embodiments, the frequency may be between 1000 HZ and 1400 HZ.

In arrangements, the cleaning oscillation may have frequency that is at least twice that of the information-transmitting signal. In other arrangements, the cleaning oscillation may have frequency that is at least five times, at least ten times, or at least twenty times greater than that of the information-transmitting signal. Likewise, in arrangements, the cleaning oscillation may have an amplitude that is no greater than half that of the information-transmitting signal. In other arrangements, the cleaning oscillation may have an amplitude that is no greater than a fifth, a tenth, or a twentieth of the amplitude of the information-transmitting signal. Also, both the cleaning oscillation and the information-transmitting oscillation may use torsional resonant frequencies, which are different from one another.

Figure 5:
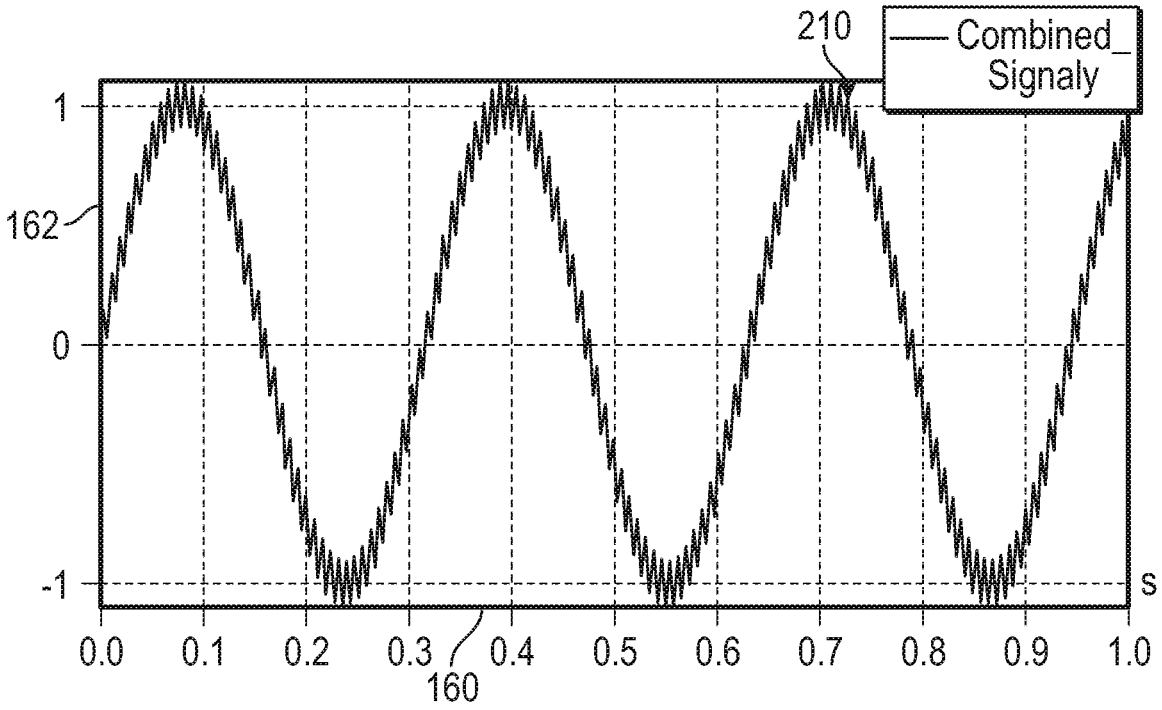
FIG. 5 illustrate an oscillation of a pulse generator that combines cleaning and signal transmission in accordance with one embodiment of the present disclosure.

FIG. 5 illustrates one non-limiting technique of using the FIG. 3 cleaning oscillation 200. In embodiments, the electronics module 150 drives the motor 142 with the cleaning oscillation 200 superimposed on the information-transmitting oscillation 190. Thus, in a sense, the rotor 122 has a macro-oscillation that imparts pressure pulses in the drilling mud 11 and a micro-oscillation that supplies kinetic energy used to dislodge materials from the stator 120 and/or rotor 122. That is, the "back and forth" micro movement of the rotor 122 may shake or scrape debris and particles from inside the passages of the stator 120 and/or rotor 122.

The cleaning oscillation 200 may be used in numerous variations. In some embodiments, the cleaning oscillation 200 may be superimposed on the information-transmitting oscillation 190. In other embodiments, the cleaning oscillation 200 may be used independently of the information-transmitting oscillation 190. Also, the cleaning oscillation 200 may be used continually, periodically, and/or "on demand." For example, the cleaning oscillation 200 may be periodically applied for a defined duration (e.g., one minute every five minutes). Other methods may use a control signal sent from a remote location (e.g., the surface) that instructs the electronics module 130 to begin or end use of the cleaning signal. Still other methods may apply the cleaning oscillation 200 based on a measured parameter. For instance, increased power usage by the motor 142 may indicate the presence of clogging, which can be used to start use of the cleaning signal. Other measured parameters may be pressure, flow rate, temperature, etc. The parameter(s) may be measured downhole and/or at the surface. Also, the electronics module 150 may be programmed to operate in a closed loop fashion based on the measured parameter(s) and/or in response to an received command signal.

Figure 6:
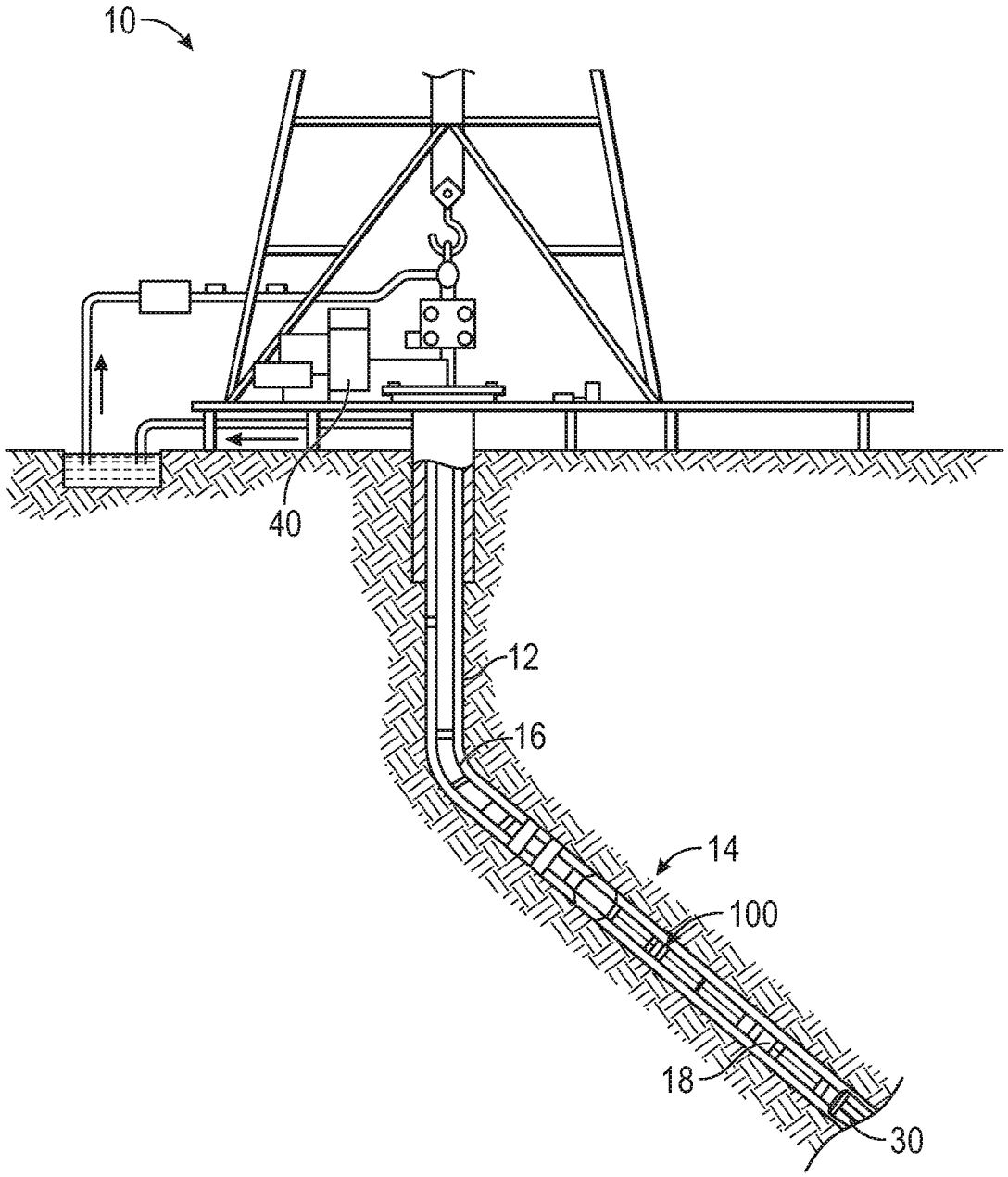
FIG. 6 schematically illustrate a drilling system that may use a pulse generator in accordance with one embodiment of the present disclosure.

Referring now to FIG. 6 there is schematically illustrated a drilling system 10 that may include a pulser 100 according to aspects of the present disclosure. A pulser 100 may be used to generate pressure pulses in a fluid circulating in a borehole 12. While a land system is shown, the teachings of the present disclosure may also be utilized in offshore or subsea applications. A drilling system 10 may have a bottom hole assembly (BHA) or drilling assembly 14 is conveyed via a string 16 (or 'drill string') into the borehole 12. The tubing 16 may include a rigid carrier, such as jointed drill pipe or coiled tubing, and may include embedded conductors for power and/or data for providing signal and/or power communication between the surface and downhole equipment. The BHA 14 may include a drilling motor 18 for rotating a drill bit 30. The BHA 14 includes hardware and software to provide downhole "intelligence" that processes measured and preprogrammed data and writes the results to an on-board memory and/or transmits the results to the surface. Processors disposed in BHA 14 may be operatively coupled to one or more downhole sensors that supply measurements for selected parameters of interest including BHA 14 or drill string 16 orientation, formation parameters, and borehole parameters. In one arrangement, the drilling system 10 may include a pulse detector 40 at a surface location. The pulse detector 40 may include a fluid and pressure sensor (not shown) in fluid communication with the fluid being circulated into the borehole 12 and/or flowing out of the borehole 12. The pulse detector 40 may also include a suitable processor and related electronics for decoding the sensed pressure pulses.

In one non-limiting mode of operation, that BHA 14 operates to drill the borehole 12. During this time, the drilling fluid, such as drilling mud, is circulated through the drill string 16. The pulser 100 may transmit communication uplinks as needed to convey information to the surface or another downhole location.

In one operating mode, the cleaning oscillation 200 is continually superimposed on the information-transmitting oscillation 190 at any time the pulser 100 is operating to transmit the communication uplinks, which yields an oscillation pattern similar to that shown in FIG. 5. In another operating mode, the cleaning oscillation 200 is used when the pulser 100 is not operating, which yields an oscillation pattern similar to that shown in FIG. 4.

As noted previously, the cleaning oscillation 200 may be applied periodically and/or "on demand." For instance, the cleaning oscillation 200 may be periodically applied for a defined duration (e.g., one minute every five minutes). Other methods may use a control signal sent from a remote location (e.g., the surface) that instructs the electronics module to begin or end use of the cleaning signal. Still other methods may apply the cleaning oscillation based on a measured parameter. For instance, increased power usage by the motor may indicate the presence of clogging, which can be used to start use of the cleaning signal. Other measured parameters may be pressure, flow rate, temperature, etc. The parameter(s) may be measured downhole and/or at the surface. Also, the electronics module may be programmed to operate in a closed loop fashion based on the measured parameter(s) and/or in response to an received command signal.

In some situations, the BHA 14 may penetrate into a weak formation. Such a formation can draw drilling fluid out of the borehole 12, thereby causing an undesirable loss of drilling fluid. To remedy such a situation, LCM may be circulated into the borehole 12 via the drill string 16. The loss situation material may include solids of much larger size than the solids present in conventional drilling fluid. The lost circulation material penetrates into the weak formation and forms a seal along a borehole wall at the weak formation. The lost circulation material being circulated in the borehole 12 may flow through the pulser 100. Advantageously, the pulser 100 may use the cleaning oscillation as described above to minimize the accumulation of entrained particles in the stator 120 and/or the rotor 122.

The present disclosure is susceptible to embodiments of different forms. There are shown in the drawings, and herein will be described in detail, specific embodiments of the present disclosure with the understanding that the present disclosure is to be considered an exemplification of the principles of the disclosure and is not intended to limit the disclosure to that illustrated and described herein.

What is claimed is:

1. An apparatus for generating pressure pulses in a fluid flowing in a downhole tool, comprising:

a stator having at least one flow passage;

a rotor having at least one flow passage, the rotor being positioned adjacent to the stator and rotatable relative to the stator;

a motor connected to the rotor, the motor being configured to oscillate the rotor relative to the stator to align and misalign the at least one flow passage of the stator and the rotor to thereby generate the pressure pulses; and an electronics module operatively connected to the motor, the electronics module configured to drive the motor using at least a first signal and a second signal, the motor causing the rotor to have an information-transmitting oscillation in response to the first signal and a cleaning oscillation in response to the second signal, wherein the cleaning oscillation has a frequency higher than the frequency of the information-transmitting oscillation and an amplitude that is lower than the amplitude of the information-transmitting oscillation.

2. The apparatus of claim 1, wherein the electronics module is configured to drive the motor simultaneously with the first signal and the second signal.

3. The apparatus of claim 1, further comprising a torsion biasing member connected to the rotor to form a spring-mass system.

4. The apparatus of claim 3, wherein at least one of the information-transmitting oscillation and the cleaning oscillation has substantially a torsional resonance frequency of the spring-mass system.

5. A method for generating pressure pulses in a fluid flowing in a downhole tool, comprising:

positioning a stator having at least one flow passage adjacent to a rotor having at least one flow passage;

connecting a motor to the rotor;

using at least a first signal and a second signal from an electronics module to drive the motor;

oscillating the rotor at an information-transmitting oscillation in response to the first signal; and oscillating the rotor at a cleaning oscillation in response to the second signal, wherein the cleaning oscillation has a frequency higher than the frequency of the information-transmitting oscillation and an amplitude that is lower than the amplitude of the information-transmitting oscillation.

6. The method of claim 5, wherein the electronics module is configured to drive the motor simultaneously with the first signal and the second signal.

7. The method of claim 5, further comprising forming a spring-mass system by connecting a torsion biasing member to the rotor.

8. The method of claim 7, wherein at least one of the information-transmitting oscillation and the cleaning oscillation has substantially a torsional resonance frequency of the spring-mass system.

9. The method of claim 5, further comprising applying the cleaning oscillation periodically for a defined duration.

10. The method of claim 5, further comprising applying the cleaning oscillation in response to a measured parameter.

11. The method of claim 10, wherein the measured parameter is a power usage of the motor.

12. The method of claim 5, wherein the frequency of the cleaning oscillation is substantially at least twice of the frequency of the information-transmitting oscillation.

13. The method of claim 5, wherein the amplitude of the cleaning oscillation is no greater than half of the frequency of the information-transmitting oscillation.

14. The method of claim 5, further comprising using a control signal from a surface location to instruct the electronics module to one of begin and end the cleaning oscillation.

15. The method of claim 5, wherein the cleaning oscillation is superimposed on the information-transmitting oscillation.

* * * * *